US005791386A

United States Patent [19]

Haslach et al.

[11] Patent Number: 5,791,386

[45] Date of Patent: Aug. 11, 1998

[54] INTERNAL CONTAINER GUIDES FOR A FILL PIPE OF A LIQUID PACKAGING MACHINE

[75] Inventors: Donald G. Haslach, Roseville; John N. Lees, Minneapolis, both of Minn.

[73] Assignee: Tetra Laval Holdings & Finance, SA, Pully, Switzerland

[21] Appl. No.: 825,352

[22] Filed: Mar. 28, 1997

[51] Int. Cl.[6] ..... B65B 1/04

[52] U.S. Cl. ..... 141/275; 141/165; 141/312; 141/374

[58] Field of Search ..... 141/114, 165, 141/166, 251, 252, 263, 275, 312, 316, 369, 370, 374, 90; 53/565, 458

[56] References Cited

U.S. PATENT DOCUMENTS

| | | | |
|---|---|---|---|
| 1,515,844 | 11/1924 | Dorris . | |
| 1,736,598 | 11/1929 | Hyatt . | |
| 2,290,747 | 7/1942 | Henry . | |
| 2,467,766 | 4/1949 | McCaslin | 141/252 |
| 2,513,143 | 6/1950 | Carter . | |
| 2,758,764 | 8/1956 | Piazze . | |
| 4,240,473 | 12/1980 | Leonard . | |
| 4,691,748 | 9/1987 | Gilmour . | |
| 4,749,010 | 6/1988 | Petell . | |
| 4,751,052 | 6/1988 | Schwartz et al. . | |
| 5,095,960 | 3/1992 | Grundler et al. | 141/166 |
| 5,145,008 | 9/1992 | Yun . | |
| 5,267,591 | 12/1993 | Wakabayashi et al. . | |
| 5,531,253 | 7/1996 | Nishiyama et al. | 141/90 |

*Primary Examiner*—J. Casmier Jacyna
*Assistant Examiner*—Steven O. Douglas
*Attorney, Agent, or Firm*—Michael A. Catania

[57] ABSTRACT

A method and apparatus for maintaining the proper shape and orientation of a carton with respect to a fill pipe of a liquid packaging machine during a liquid-filling operation. The apparatus, internal carton guides attached to a fill pipe, are elongated fin-shaped members which are adapted to engage opposite corners of a carton. The internal container guides include tapered lowered edges which gradually direct the corners of the carton to the outermost edges of the guides. The uppermost edges of the internal container guides include stop members which serve to engage the top edge of the container and inhibit any further upward movement. The internal container guides securely maintain the container in a stable and properly-oriented position throughout the liquid-filling operation.

8 Claims, 7 Drawing Sheets

INTERNAL CONTAINER GUIDES FOR A FILL PIPE OF A LIQUID PACKAGING MACHINE

BACKGROUND OF THE INVENTION

Packaging of liquid foodstuffs and the like is most often done with the help of a modem packaging machine which, at a high rate of production, manufactures filled, sealed packages under hygienically acceptable production conditions. Such a packaging machine operates to form, fill and seal a container, such as a gable-top container, from a suitable material, usually plastic-coated paper. In the formation and filling of a gable-top container, flattened blanks are first erected to form open, tubular containers of generally rectangular cross-section. The blanks are then transferred to a first forming station of the machine which closes and seals one end of each container. Thereafter, the containers are typically placed on a conveyor and carried to the filling station of the machine where the containers are filled with the desired portions of liquid product.

The filling station usually comprises one or more fill pipe assemblies. Each fill pipe assembly is connected to receive product from a product supply tank through an intermediate metering pump. The metering pump is controlled to pump a predetermined volume of product through the fill pipe assembly and into the containers advanced along a container transport path immediately below the fill pipe assembly. From the filling station, the filled containers are conveyed to a final forming station of the machine where the containers, by means of forming and sealing mechanisms, are given a liquid-tight top closure. Thereafter, the containers, in the form of finished consumer packages, are discharged from the machine for further distribution.

As may be suggested from the above-described container-forming procedure, the newly-formed tubular containers, which are advanced along a container transport path in preparation for a liquid-filling operation, are not perfectly "square" nor entirely stable. If a liquid-filling operation is to be both accurate and spill-free, it is imperative that the liquid-filling machine/system somehow ensure that the container is securely maintained in the proper shape, orientation and position throughout the entire liquid-filling process. Also of interest in this regard is a means of accomplishing such proper container alignment without having to sacrifice production rate or having to clutter the filling area with cumbersome container-positioning apparatus.

SUMMARY OF THE INVENTION

A system for securely maintaining the proper shape and orientation of a newly-formed container during a production cycle at a filling station of a liquid packaging machine is set forth. The system comprises a fill pipe assembly having a discharge end through which liquid product may flow into a container disposed therebelow during such production cycle. Two internal container guides, positioned at 180 degrees with respect to each other, are affixed to an external surface of the fill pipe and adapted to engage diagonally-opposed internal corners of the container as the container is raised and lowered during a production cycle.

Each internal container guide has an elongated fin shape resulting in a substantially vertical outer edge which engages an internal corner area of the container. The internal container guides are tapered proximate the discharge end of the fill pipe so that they do not interfere with the proper engagement between the guides' outer edges and the opposing corners of the container as the container is lifted by a lift mechanism toward the discharge end of the fill pipe for filling with liquid product. Upper edges of the internal container guides are preferably provided with stop members which extend outward slightly further than the outer edges of the guides so as to engage, and prevent further movement of, the upper edge of a container as it is lifted into the proper position for filling.

In connection with a related machine operation, the bottom edges of the internal container guides extend outward a measurable distance from the fill pipe and are substantially perpendicular thereto. These bottom edges provide an abutment against which a clean-in-place manifold may be positioned for a fill pipe cleaning operation.

In a preferred method of operation, a newly-formed container is positioned beneath the discharge end of the fill pipe assembly so that the lift rod, operated by a lift mechanism, engages the bottom of the container. The lift rod is thereafter programmed to move vertically upward a predetermined distance to urge the internal surfaces of two opposingly-positioned corners of the container into engaging relation with the internal container guides whereby the discharge end of the fill pipe is concentrically received within the container. As the liquid product is dispensed into the container, the lift rod simultaneously lowers the container back on to the conveyor—all the while the container being maintained in its proper shape and orientation by the internal container guides.

DETAILED DESCRIPTION OF THE INVENTION

Figure 1:
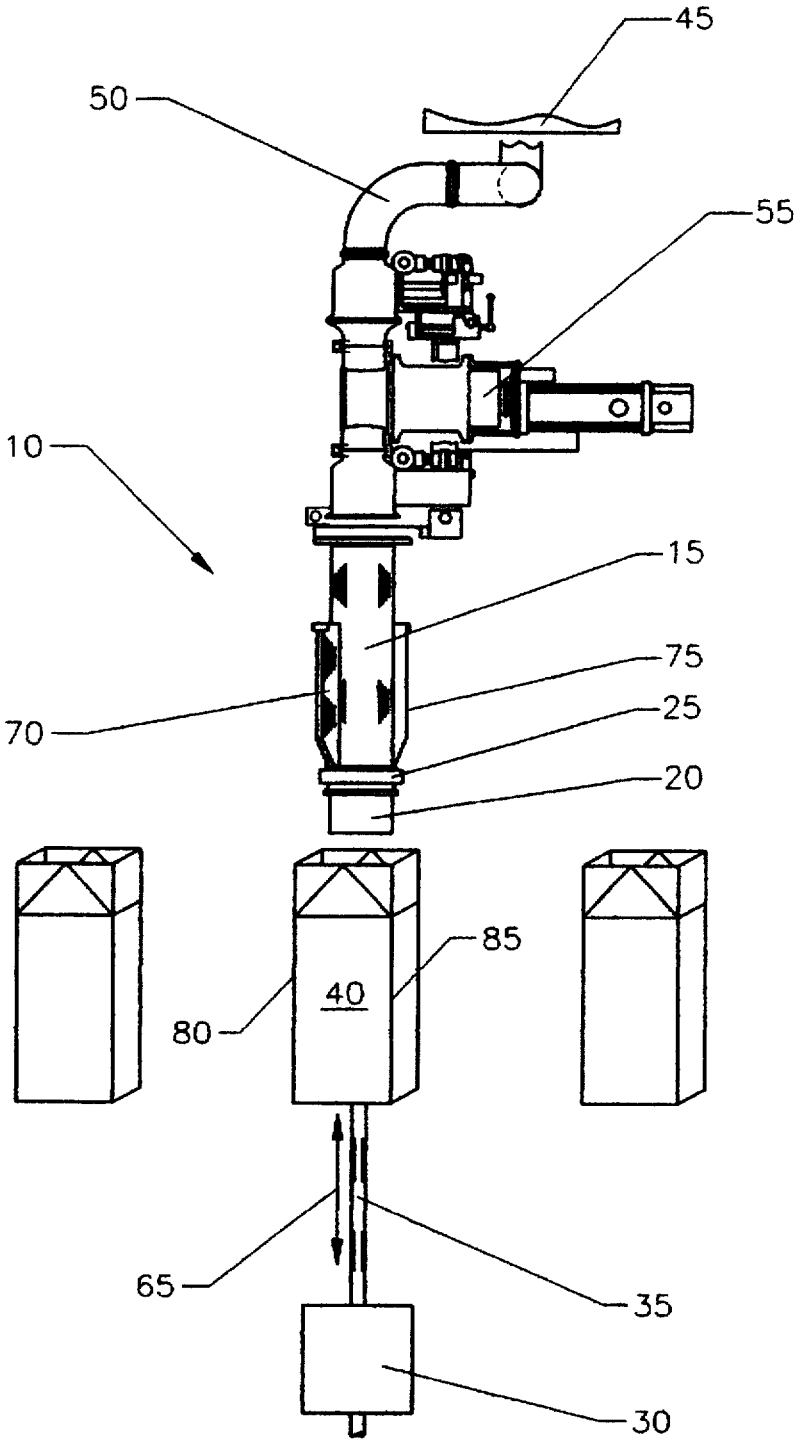
FIG. 1 is a side view of a filling system incorporating one embodiment of the internal container guides of the present invention.

Referring to FIG. 1, one embodiment of a filling assembly 10 of a packaging machine is shown operating in a production cycle. The filling assembly includes a fill pipe 15 having a discharge end 20 that, depending on the type of filling system and nature of the dispensed product, may have a flexible, pressure-actuated nozzle disposed thereover. A radially-extending collar 25, formed either integral with the fill pipe 15 or as a separate piece that joins the body of the fill pipe to the discharge end 20, is disposed proximate the discharge end 20. A lift mechanism 30 having, for example, a lift rod 35 for engaging a container is disposed below the discharge end 20 of the fill pipe 15. Such system advantageously incorporates the use of internal container guides 70 and 75.

In accordance with a production cycle of the packaging machine, a container 40 (typically one of a plurality of containers on container supports disposed on an endless conveyor belt) is engaged on its underside by the lift rod 35 of the lift mechanism 30 and is driven vertically so that the container 40 is placed proximate the discharge end 20 of the fill pipe 15. Thereafter, container 40 may receive the desired product 45 Which is supplied through supply pipe 50 via pump assembly 55 and dispensed through fill pipe 15. As container 40 is being raised into the proper filling position, container guides 70 and 75 mounted upon fill pipe 15 engage internal diagonally-opposed comers 80 and 85 of the container 40 to ensure that container 40 maintains a proper shape and orientation during the filling process. Thus, the container 40 remains properly aligned with the discharge end 20 of the fill pipe 15 even when it is raised above the supports of the endless belt conveyor.

As product 45 is being discharged into the container 40, the lift mechanism 30 lowers the container 40 in accordance with a predetermined motion profile until it is again disposed in the container supports of the endless belt conveyor (not illustrated). Preferably, particularly in instances in which a liquid product is discharged into the container 40, the lift mechanism 30 lowers the container 40 so as to maintain the nozzle (not illustrated) that is disposed at the discharge end 20 below the level of the liquid in the container 40. The vertical movement described is shown generally at 65.

Figure 2:
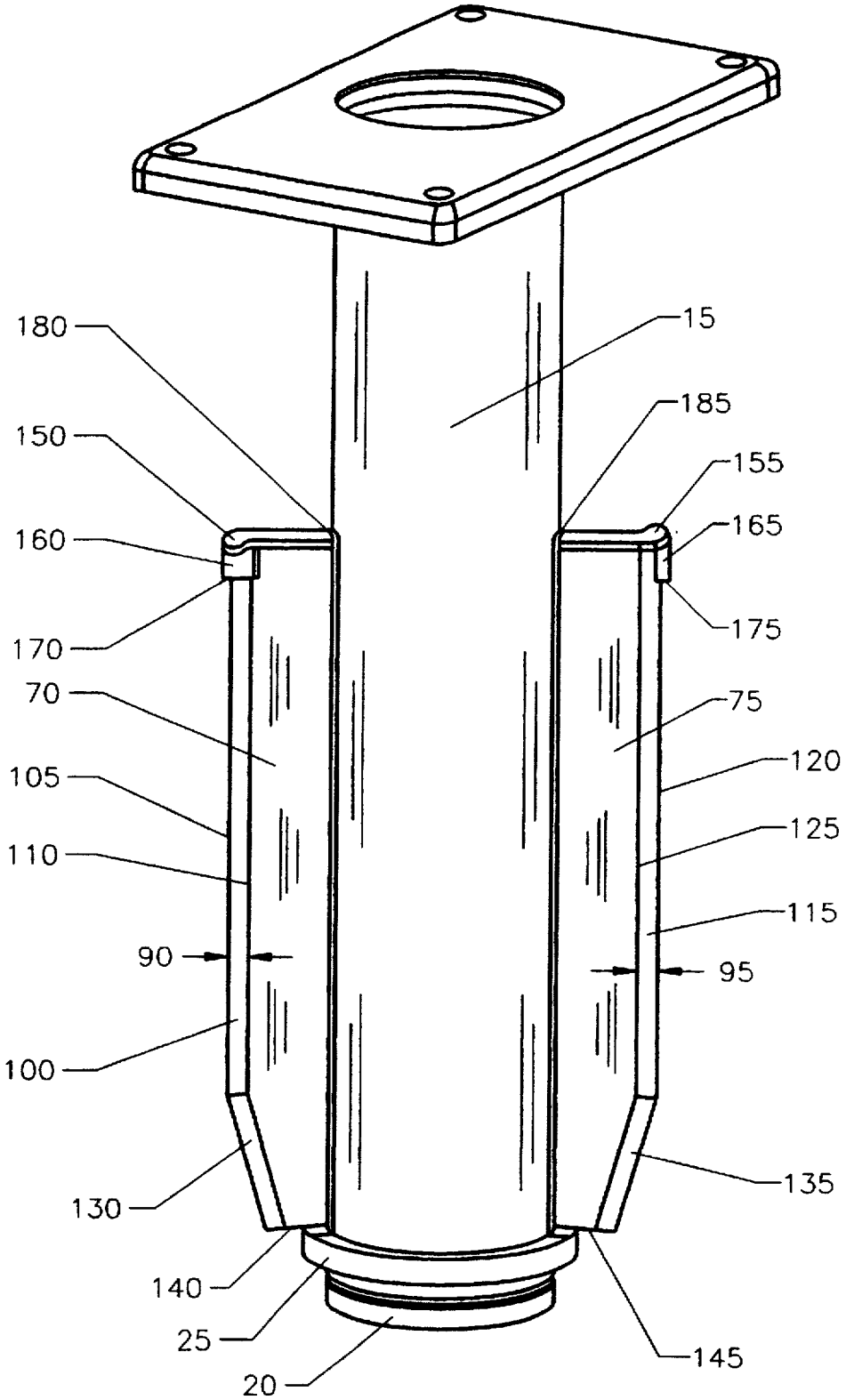
FIG. 2 is a perspective view of one embodiment of the internal container guides that may be used with the fill pipe and filling system of FIG. 1.

FIG. 2 shows one embodiment of the internal container guides 70 and 75 affixed to fill pipe 15. Given that internal container guides 70 and 75 are identical, specific details of internal container guide 70 only will be discussed with like reference numerals for internal container guide 75 being indicated in parenthesis.

Internal container guide 70 (75) has a substantially elongated body which is affixed to fill pipe 15 along seam 180 (185). Internal container guide 70 (75) includes an outer edge 100 (115) having a width 90 (95) which is defined by guide corners 105, 110 (120, 125). During a liquid filling operation, guide corners 105, 110 (120,125) serve to engage the internal surfaces of a corner area of a container (further details shown in FIGS. 3 and 4).

Contiguous with the outer edge 100 (115) is a tapered lower edge 130 (135) which terminates at a bottom edge 140 (145). The inwardly-angled design of tapered lower edge (130) (135) ensures that internal container guide 70 (75) is properly received within the corner area of a container for engagement therewith during a liquid-filling operation.

Bottom edge 140 (145) is substantially perpendicular to the central axis of fill pipe 15 and extends a measured distance outward from fill pipe 15 beyond the collar 25 and discharge end 20. Bottom edge 140 (145) serves as a horizontal abutment against which, for example, clean-in-place manifolds may be positioned and affixed with respect to fill pipe 15 during a fill pipe cleaning operation.

Affixed to the uppermost edge of internal container guide 70 (75) is a stop member 150 (155). Stop member 150 (155) further includes a collar 160 (165) which substantially surrounds the uppermost end of outer edge 100 (115) and associated guide comers 105, 110 (120, 125). Such configuration ensures that a lower edge 170 (175) of collar 160 (165) will contact an upper comer edge of a container during a liquid-filling operation and inhibit the container's vertical movement upward at such contacting point.

Figure 3:
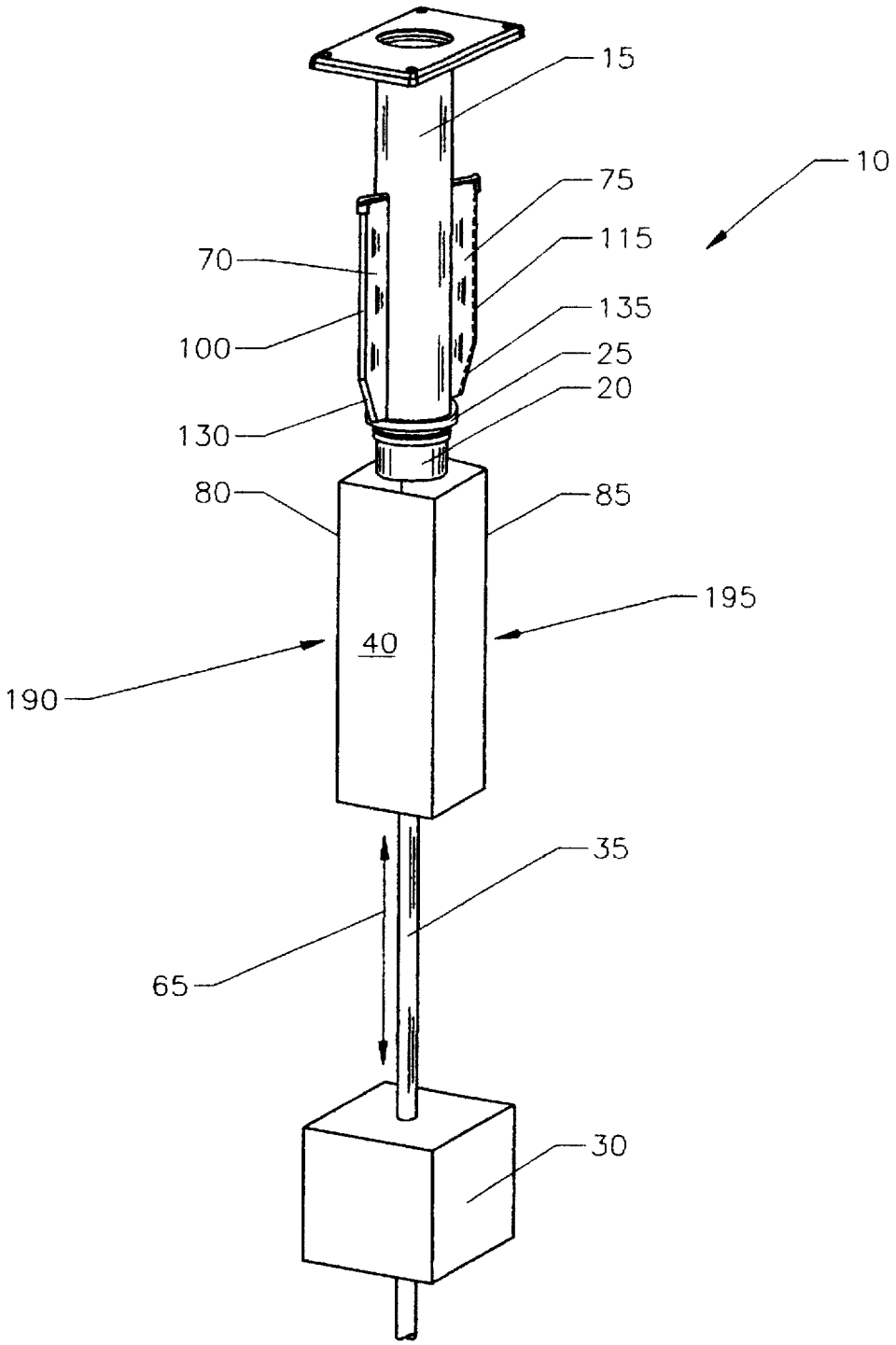
FIG. 3 is a perspective view of the filling system of FIG. 1 wherein a container is engaged by a lift member of a lifting mechanism and disposed below a fill pipe with internal container guides prior to operational engagement therewith.

Operation of the filling assembly 10 of the embodiment of FIG. I pursuant to a container-filling operation of the machine can be described in connection with FIGS. 3 and 4. As illustrated, a newly-formed container 40 is initially positioned immediately beneath the discharge end 20 of fill pipe 15 in preparation for a liquid-filling operation. Facilitating the vertical movement 65 of the container 40 is the lift rod 35 which is, in turn, actuated by lift mechanism 30. Internal carton guides 70 and 75 are specifically aligned with respect to container 40 so that corners 80 and 85 of container 40 receivably engage outer edges 100 and 115, respectively, of internal container guides 75 and 75.

Given that container 40 is a newly-formed carton from an initially flat carton blank, corners 80 and 85 might still have a tendency to be biased toward one another in the directions generally indicated at 190 and 195. As the container 40 is further raised into operational engagement with internal container guides 70 and 75, comers 80 and 85 will initially engage tapered lower edges 130 and 135 whereupon they are gradually guided into their proper liquid-filling positions adjacent outer edges 100 and 115. Indeed, once the container 40 is in the position illustrated in FIG. 3, the lift mechanism 30 is operated to drive the lift drive 35 and the container 40 to the position illustrated in FIG. 4. As noted in FIG. 4, internal container guides 70 and 75 are received almost entirely within the interior of the container 40 whereby the internal corner areas associated with corners 80 and 85 are in linear engagement with outer edges 100 and 115 (not shown) of internal container guides 70 and 75. The vertical movement 65 of container 40 is inhibited once the upper edge of the container 40 engages lower edges 170 and 175 of collars 160 and 165 of stop members 150 and 155.

Figure 4:
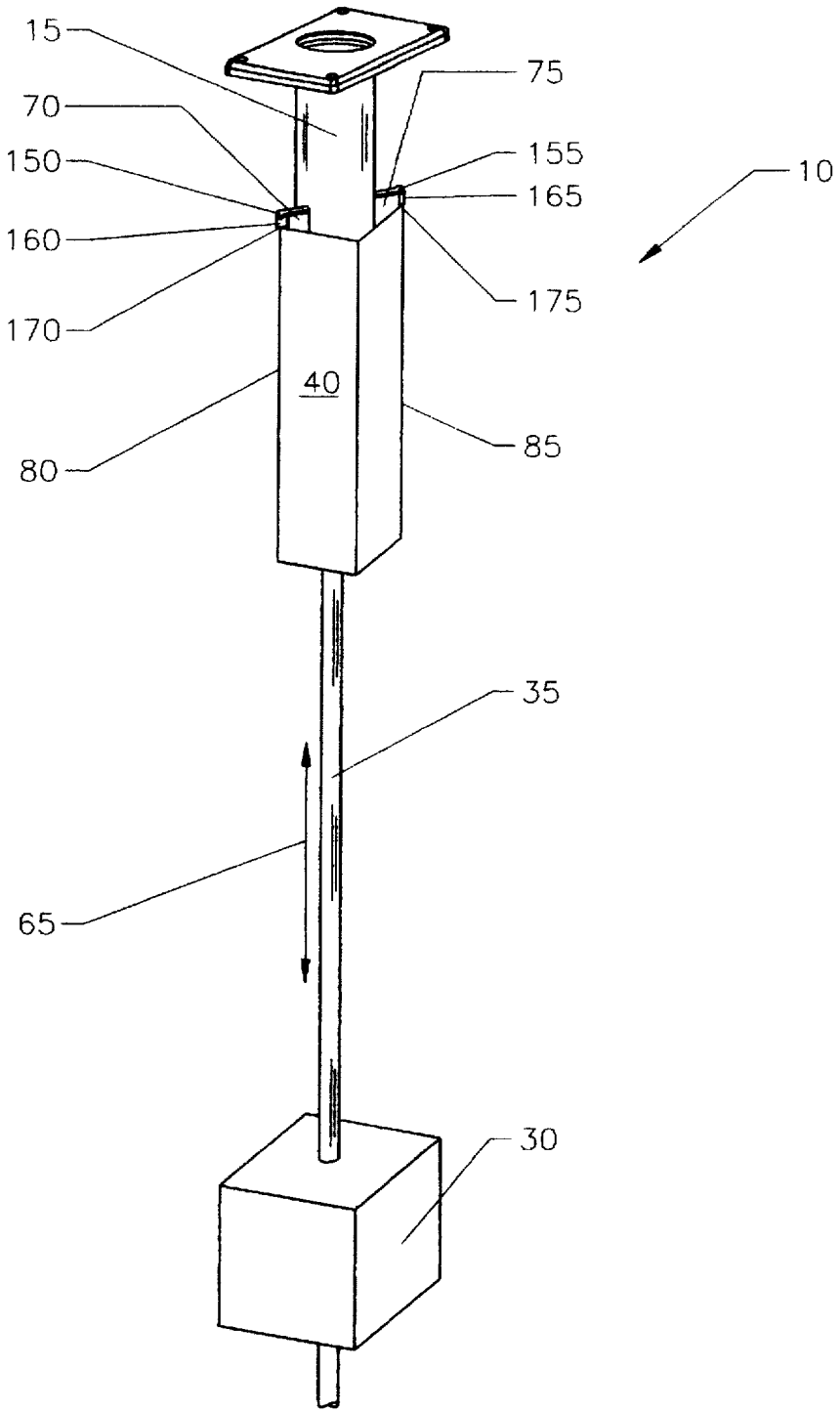
FIG. 4 is a perspective view of the filling system of FIG. 3 wherein the container is in operational engagement with the fill pipe and internal container guides, the container being supported in place by a lift member of a lifting mechanism.

Once in the position shown in FIG. 4, a fill system 10 and container 40 are ready to undergo a liquid-filling operation. During such operation, lift mechanism 40 gradually lowers lift rod 35 and container 40 whereby internal container guides 70 and 75 remain engaged with corners 80 and 85 to maintain the proper shape and orientation of container 40 as the desired liquid product is being delivered therein.

Figure 5:
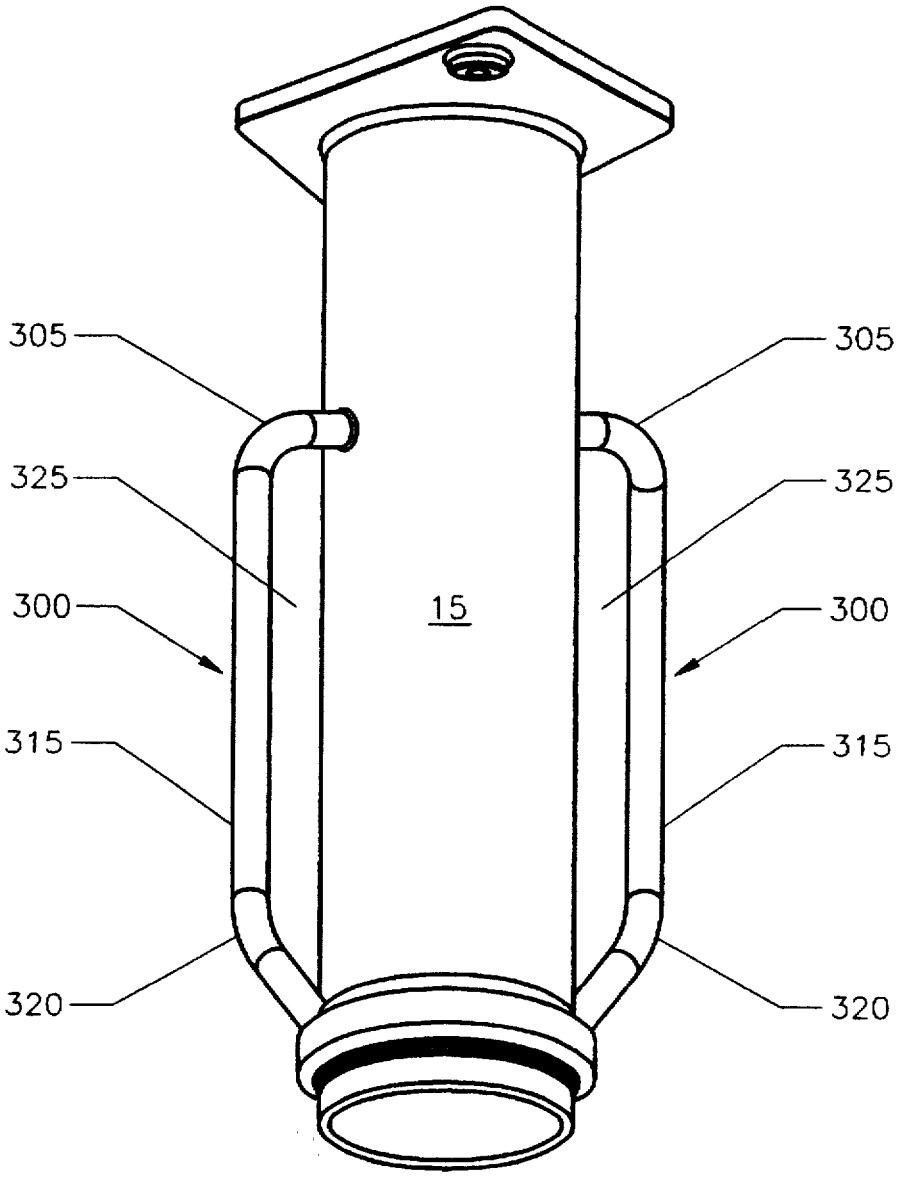
FIG. 5 is a perspective view of external carton guides in accordance with a further embodiment of the present invention.

FIG. 5 illustrates internal carton guides in accordance with a further embodiment of the present invention. As shown, each carton guide 300 is in the form of a narrow tubular projection extending from the external sidewall of the fill pipe 15. Each carton guide comprises a first upper portion 305 connected to and extending generally perpendicular from the fill pipe 15 and terminating at a rounded end portion. The rounded end portion of the first upper portion 305 engages a substantially vertical portion 315 which comprises the majority of the length of each carton guide 300. At the lower end of each carton guide 300, the substantially vertical portion 315 engages a tapered end portion 320 that again engages the sidewall of the fill pipe 15. The portions 305, 315, and 320 define a substantially open region 325. A projection 330 extending from each of the vertical portions 315 is provided as a carton stop.

Depending on the design constraints of the fill system in which the present invention is employed, the embodiment of FIG. 5 provides several advantages. First, the carton guides 300 do not "shadow" other components to the same degree as do the carton guides 70, 75 of the prior figures given the substantially open regions 325 that are present. As such, components of the machine that are proximate the carton guides 300 are more effectively cleaned during a clean-in-place operation. Second, the carton guides 300 may serve as points of attachment for other system components.

Figure 6:
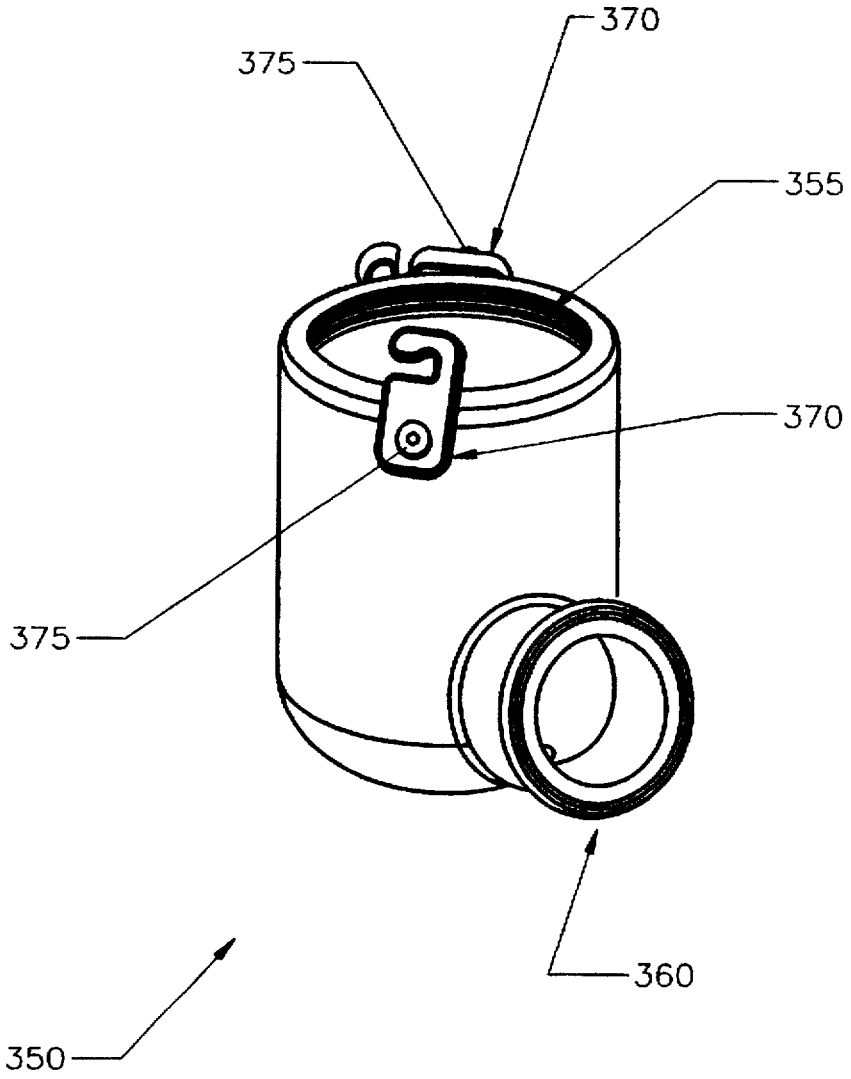
FIG. 6 is a perspective view of a clean-in-place manifold for attachment to the external carton guides of FIG. 5.
Figure 7:
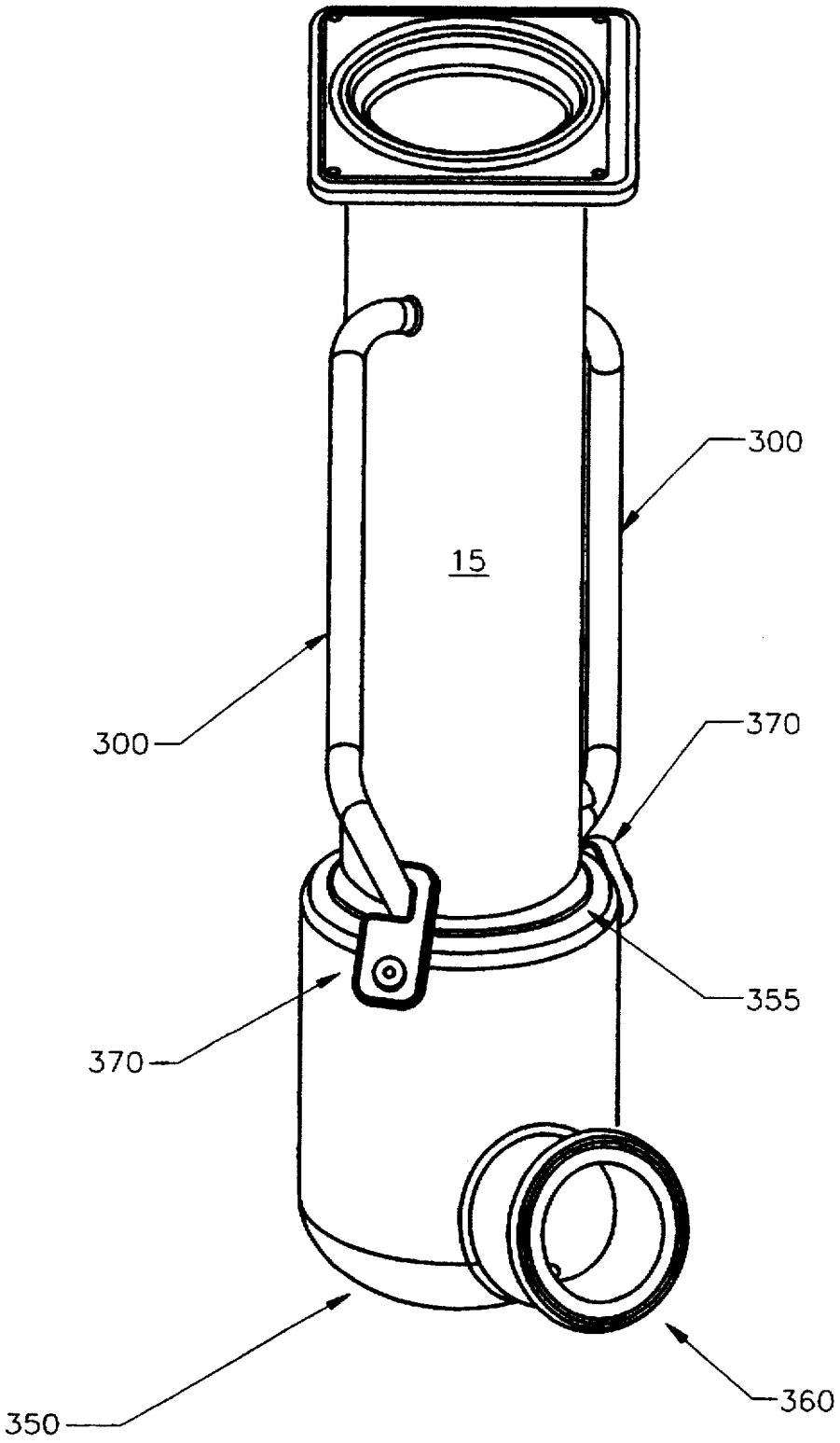
FIG. 7 is a perspective view of the manifold of FIG. 6 attached to the carton guides of FIG. 5.

FIGS. 6 and 7 illustrate the second advantage noted above. A clean-in-place manifold for placement over the outlet end of the fill pipe 15 and connection to the carton guides 300 is shown generally at 350 of FIG. 6. The manifold 350 comprises a first aperture 355 that is dimensioned to engage and seal over the outlet end of the fill pipe 15. The aperture 355 may accordingly be provided with the necessary gaskets. One such construction is illustrated in U.S. Ser. No. 08/828/307 (Attorney Docket No.11580US01), titled "Method And Apparatus For Cleaning A Fill Pipe Of A Liquid Packaging Machine", filed on even date herewith. A second drain aperture 360 is disposed at a lower portion of the manifold 350 and serves as a connection point for a drain pipe or the like.

A pair of pivotable hooks 370 are disposed proximate the first aperture 355. Each hook 370 is connected to the manifold 350 at a pivot securement 375 which allows each hook 370 to pivot between a first position illustrated by the foreground hook 370 and a second position illustrated by the background hook 370.

As shown in FIG. 7, the hooks 370 are disposed on the manifold 350 at positions corresponding to the carton guides 300 when the manifold 350 is disposed over the outlet end of the fill pipe 15. Further, the hooks 370 are dimensioned to engage and secure with the carton guides 300 when moved to their respective first positions. As such, the cooperation between the hooks 370 and the carton guides 300 provides securement of the manifold 350 to the outlet end of the fill pipe 15 during a clean-in-place cycle of the machine. Removal of the manifold 350 from the fill pipe 15 is accomplished by simply urging the manifold 350 in an upward direction and moving each of the hooks 370 to their respective second positions.

Although the present invention has been described with reference to a specific embodiment, those of skill in the art will recognize that changes may be made thereto without departing from the scope and spirit of the invention as set forth in the appended claims.

We claim:

1. In a liquid-packaging machine for forming, filling and sealing a container, an apparatus for facilitating the proper formation and placement of a container during the container's liquid-filling operation, the apparatus comprising: a fill pipe assembly having a discharge end through which liquid product may flow into said container disposed therebelow; a plurality of elongated container guides, each of said guides being affixed to an exterior surface of said fill pipe wherein a length of each said guide is substantially parallel to a central axis of said fill pipe, each of said guides further projecting outward from said fill pipe to define opposing guide surfaces and an outer edge adapted to engage one internal corner area of said container during said liquid-filling operation; and a stop member affixed to a top surface of each of said guides, each said stop member projecting outward from said outer edge to inhibit further upward movement of said container past said stop member.

2. The apparatus of claim 1, wherein said apparatus includes two container guides, each said guide positioned at 180 degrees about said fill pipe with respect to the other.

3. The apparatus of claim 1 wherein each of said guides further including a tapered lower edge contiguous with said outer edge and running inward and downward from said outer edge toward said exterior surface of said fill pipe, said tapered lower edge adapted to initially engage said internal corner area of the container should the internal corner area not be in its properly formed shape, said tapered lower edge terminating with a flat bottom edge, said flat bottom edge being perpendicular to said central axis of said fill pipe and adapted to serve as an abutment for cleaning manifolds attached to said fill pipe for pipe cleaning operations, and wherein said apparatus includes two container guides, each said guide positioned at 180 degrees about said fill pipe with respect to the other.

4. In a liquid-packaging machine for forming, filling and sealing a container, an apparatus for facilitating the proper formation and placement of a container during the container's liquid-filling operation, the apparatus comprising:

a fill pipe assembly having a discharge end through which liquid product may flow into a container disposed therebelow;

a plurality of elongated container guides, each of said guides being affixed to an exterior surface of said fill pipe wherein a length of each said guide is substantially parallel to a central axis of said fill pipe, each of said guides further projecting outward from said fill pipe to define opposing guide surfaces and a substantially flat outer edge adapted to engage one internal corner area of the container during said liquid-filling operation, said outer edge substantially parallel to said central axis of said fill pipe and substantially perpendicular to said opposing guide surfaces, said outer edge of sufficient length to engage a substantial portion of the internal corner area of the container, each of said guides further including a tapered lower edge contiguous with said outer edge and running inward and downward from said outer edge toward said exterior surface of said fill pipe, said tapered lower edge adapted to initially engage said internal corner area of the container should the internal corner area not be in its properly formed shape, said tapered lower edge terminating with a flat bottom edge, said flat bottom edge being substantially perpendicular to said central axis of said fill pipe and adapted to serve as an abutment for cleaning manifolds attached to said fill pipe for pipe cleaning operations.

5. The apparatus of claim 4 further comprising stop members affixed to a top surface of each of said guides, each said stop member projecting outward from said outer edge to inhibit further upward movement of the container past said stop member.

6. A fill pipe assembly comprising:

a fill pipe; and at least two carton guides connected to the fill pipe and disposed to engage internal corner sections of a corresponding container when the container is lifted over an outlet end of the fill pipe, each of the carton guides being comprised of an upper section connected to an upper section of the fill pipe, a lower section connected to a lower section of the fill pipe, and a substantially vertical section connecting the upper and lower sections of each carton guide, the upper section, lower section, and substantially vertical sections of each carton guide defining a substantially open region, the carton guides formed as tubular members.

7. A fill pipe assembly as claimed in claim 6 and further comprising:

a clean-in-place manifold;

releasable securements on the clean-in-place manifold for attachment to the carton guides, the releasable securements securing the manifold in sealing engagement with an outlet end of the fill pipe when the securements are attached to the carton guides.

8. A fill pipe assembly as claimed in claim 7 wherein the releasable securements are hook members.

* * * * *